US006053774A

United States Patent [19]

Lin

[11] Patent Number: 6,053,774

[45] Date of Patent: Apr. 25, 2000

[54] MINIATURE LIGHT BULB SOCKET STRUCTURE HAVING AN INSERT TO KEEP WIRE TERMINALS SEPARATE

[76] Inventor: Fong Shi Lin, No. 196, Chin Long Road, Hsio Chin Ko Chang, Hwei Chou City, KaunTon, China

[21] Appl. No.: 09/179,902

[22] Filed: Oct. 28, 1998

[51] Int. Cl.[7] ..... H01K 1/00

[52] U.S. Cl. ..... 439/619

[58] Field of Search ..... 439/619, 457, 439/541, 574, 575; 362/219, 252, 249, 226, 391, 806

[56] References Cited

U.S. PATENT DOCUMENTS 5,620,343 4/1997 Pan ..... 439/699.2
5,810,621 9/1998 Tsai ..... 439/619

*Primary Examiner*—Lincoln Donovan
*Assistant Examiner*—Chandrika Prasad
*Attorney, Agent, or Firm*—Rosenberg, Klein & Lee

[57] ABSTRACT

An improved miniature light bulb socket provided with an insert to keep wire terminals separate. The socket mainly comprises a socket shell in which a Y-shaped insert is seated with two opposed protrusions engaged with the grooves of the socket shell. With such an arrangement the electrical wires and terminals extending into the socket can be kept separate effectively and prevented from their shorting. Further, the socket has a conductor pin disposed on the top of the insert and kept in touch with two electrical wire terminals and so the electrical circuit of a miniature light bulb series can be kept closed even if the light bulb on the socket is burned down. It can have an advantage that the light bulb series can still work even if some bulbs of the light bulb series fail. The improved light bulb socket structure according to the invention indeed enhances the practical value of a socket.

2 Claims, 3 Drawing Sheets

MINIATURE LIGHT BULB SOCKET STRUCTURE HAVING AN INSERT TO KEEP WIRE TERMINALS SEPARATE

BACKGROUND OF THE INVENTION

A decorative light bulb series generally consists of a plurality of miniature light bulb sockets. Those light bulb sockets are small and are provided with light bulbs mounted thereon and electrical wires extending into the socket shells. Those electrical wires in such a small space can easily get in touch with each other, resulting in circuit-short and damage and leading to a loss. Further, for the serial connection of the light bulb series, a broken-down light bulb can make the whole series fail in function. Hence it is desirable to have an improvement made on the disadvantage of a conventional light bulb socket structure.

In view of the problem described in the preamble, the object of the invention is to provide an improved miniature light bulb socket structure that has an insert that can effectively keep wire terminals separate and in which the disadvantage of conventional light bulb sockets is overcome.

BRIEF DESCRIPTION OF THE DRAWINGS

The features and advantages of the invention will become apparent from the following description of embodiments with reference to the accompanying drawings in which.

DESCRIPTION OF THE PREFERRED EMBODIMENTS

Figure 1:
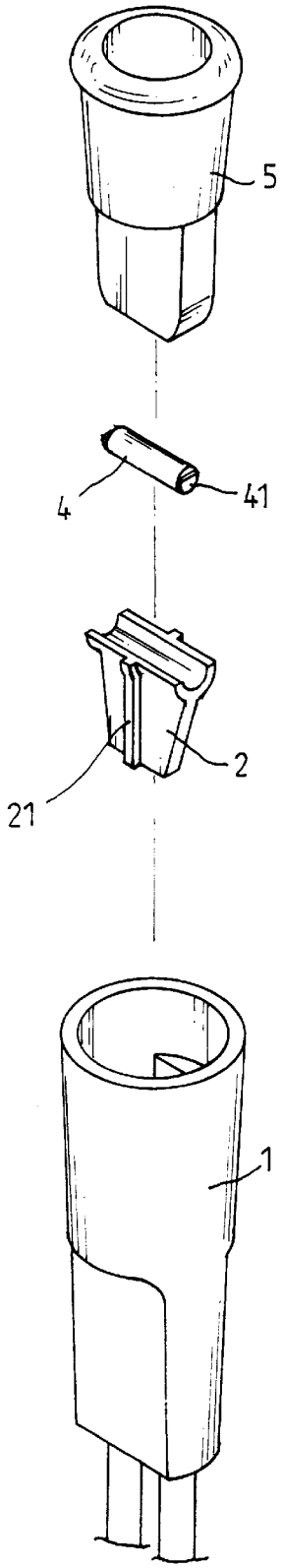
FIG. 1 is an exploded view schematically illustrating the construction of an insert for positioning and separating wire terminals in a miniature light bulb socket in accordance with an embodiment of the invention.
Figure 2:
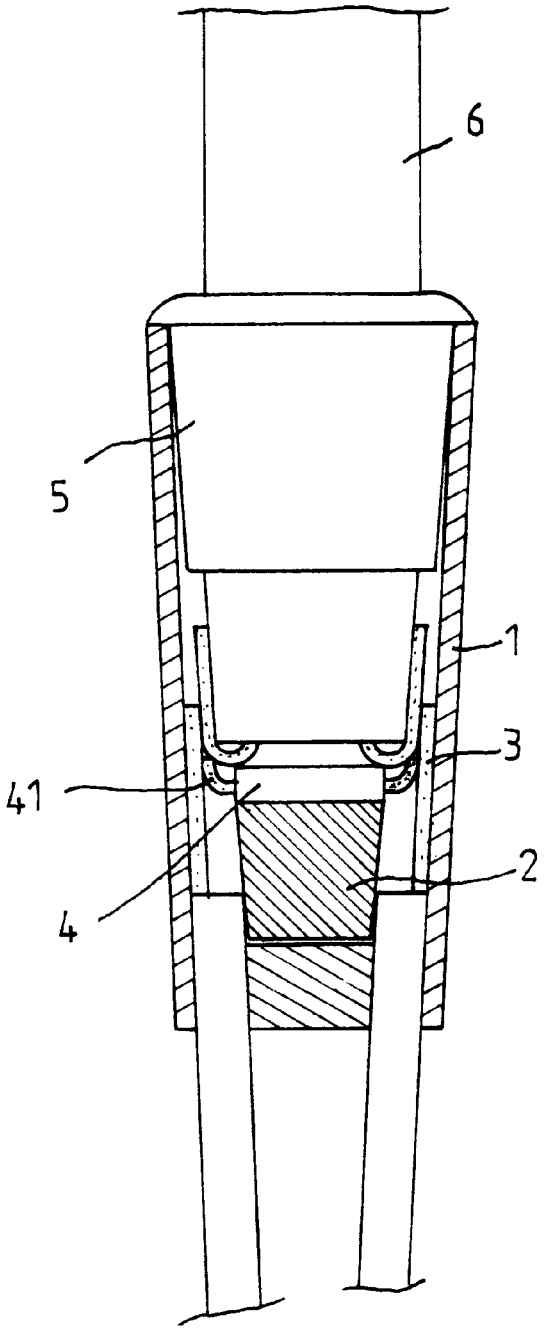
FIG. 2 is an assembly cross sectional view of the insert of FIG. 1.
Figure 3:
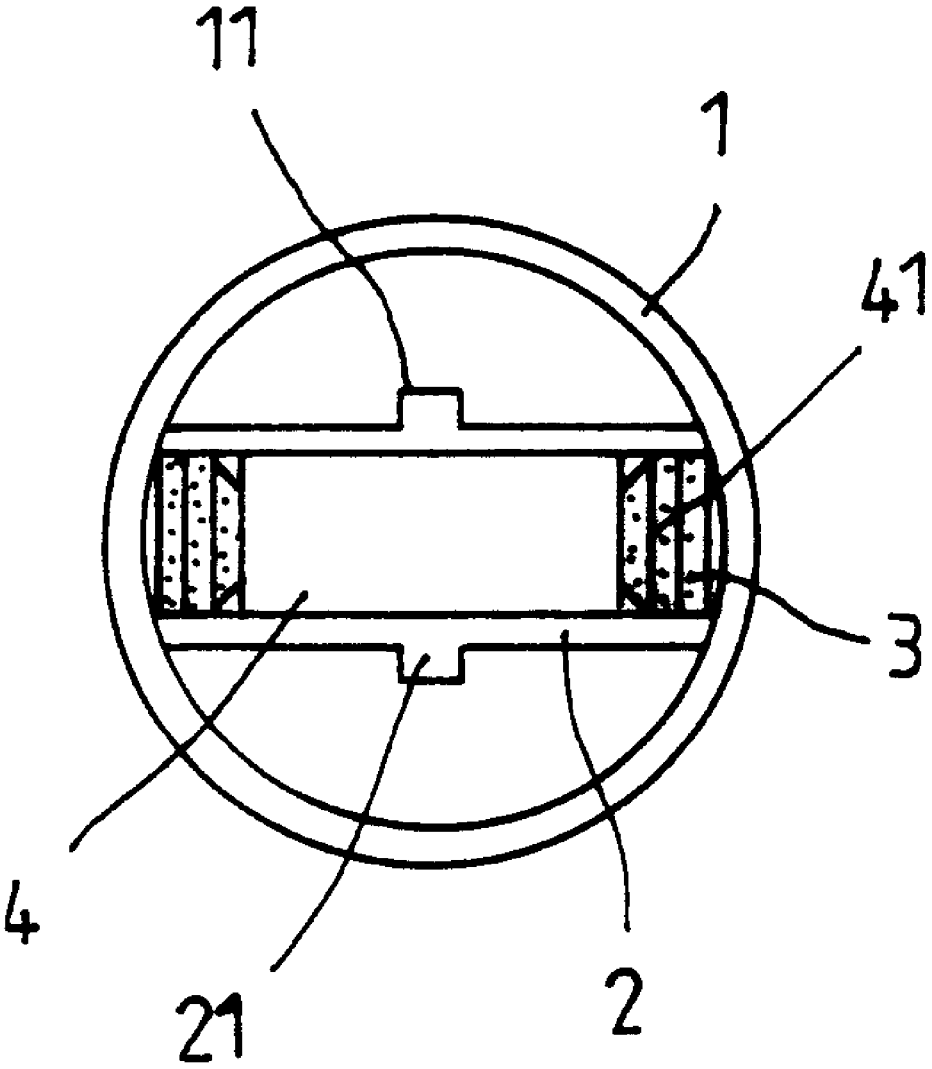
FIG. 3 is a top view of a miniature light bulb socket assembly having the insert of FIG. 1.

Referring to the drawings, the invention is characterized in that a socket shell (1) is provided with a Y-shaped insert (2). The socket shell (1) is provided on its internal wall surface with two opposite grooves (11). Also, the insert (2) is equipped on two opposite sides thereof with a protrusion (21), which extends into the grooves (11) when the insert (2) is seated inside the socket shell (1) to help locating the insert (2) in the socket. Thus the insert (2) can effectively keep two wire terminals (3) apart to prevent them from shifting or shortening, obtaining a safety protection.

The further feature of the invention consists in a secondary conductor pin (4) disposed on the top of the Y-shaped insert (2). The pin (4) is held by the Y-shaped insert (2). However, it can also be integrated with the Y-shaped insert (2) by molding to form a single piece. Respectively arranged on two opposed ends of the conductor pin (4) are two metal pieces (41), which are designed to make a resilient contact with one wire terminal (3) when the conductor pin is seated inside the socket shell (1).

The miniature light bulb socket according to the invention is completed by mounting a light bulb holder (5) and a light bulb (6) on the top of the socket shell (1). Therefore the socket of the invention can allow electrical current to pass through the conductor pin to keep the circuit closed even if the light bulb has been burned down and so other light bulb sets can still light up. Users can easily find the broken-down light bulb and replace it immediately. Thus the invention also has the advantage of saving the investigation time of a malfunctioned light bulb series. Evidently the invention is useful and has practical value for the industry. It meets the essence of a patent. Hence we hereby apply for a grant of a patent.

What is claimed is:

1. An improved miniature light bulb socket, comprising:

a light bulb socket shell having two opposed grooves formed in internal wall surfaces thereof;

a pair of wire terminals disposed in a rear end of said socket shell;

a bulb holder disposed in a front end of said socket shell, said bulb holder having a light bulb with a pair of leads respectively contacting said pair of wire terminals;

a Y-shaped insert having a protrusion formed on two opposite sides thereof for respective engagement with said grooves of said socket shell to locate said Y-shaped insert in said socket shell to effectively maintain said wire terminals separate from one another; and, a secondary conductor pin supported on said Y-shaped insert, said secondary conductor pin having contacts formed on opposing ends thereof for respectively contacting said pair of wire terminals and thereby provide a current path therebetween in parallel with said light bulb.

2. An improved miniature light bulb socket, comprising:

a light bulb socket shell having two opposed grooves formed in internal wall surfaces thereof;

a pair of wire terminals disposed in a rear end of said socket shell;

a bulb holder disposed in a front end of said socket shell, said bulb holder having a light bulb with a pair of leads respectively contacting said pair of wire terminals; and, a Y-shaped insert having a protrusion formed on two opposite sides thereof for respective engagement with said grooves of said socket shell to locate said Y-shaped insert in said socket shell to effectively maintain said wire terminals separate from one another, said Y-shaped insert including an integrally formed secondary conductor pin, said secondary conductor pin having contacts formed on opposing ends thereof for respectively contacting said pair of wire terminals and thereby provide a current path therebetween in parallel with said light bulb.

* * * * *